US005598886A

United States Patent [19]

Criado-Mellado

[11] Patent Number: 5,598,886

[45] Date of Patent: Feb. 4, 1997

[54] FOOD DISPLAY AND PRESERVATION CASE

[76] Inventor: Antonio Criado-Mellado, Almáchar, 16-18, Polígono Industrial Guadalhorce, 29004 Malaga, Spain

[21] Appl. No.: 489,949

[22] Filed: Jun. 13, 1995

[30] Foreign Application Priority Data

Jun. 15, 1994 [ES] Spain ..... 9401658

[51] Int. Cl.[6] ..... F25B 29/00

[52] U.S. Cl. ..... 165/254; 62/246; 62/258; 165/918

[58] Field of Search ..... 62/246, 258, 249; 165/918, 919, 27

[56] References Cited

U.S. PATENT DOCUMENTS

| | | | |
|---|---|---|---|
| 2,973,631 | 3/1961 | Adkins | 62/246 |
| 3,308,633 | 3/1967 | Kritzer, Jr. | 165/919 X |
| 4,572,598 | 2/1986 | Moore, Jr. | 62/246 X |
| 4,856,579 | 8/1989 | Wolfe | 165/918 X |
| 5,117,649 | 6/1992 | Mangini et al. | 62/258 X |
| 5,355,687 | 10/1994 | Carpenter et al. | 62/258 |
| 5,363,672 | 11/1994 | Moore et al. | 165/918 X |
| 5,421,170 | 6/1995 | Sodervall | 62/249 |

OTHER PUBLICATIONS

Curt E. G. (Editor)(1994) Gran Hotel—turismo–viajes, 1994, No.18:68–9. (English translation included).

*Primary Examiner*—William E. Tapoicai
*Attorney, Agent, or Firm*—Klauber & Jackson

[57] ABSTRACT

A food display and preservation case comprising at least one support member provided with wheels and brakes. The support member houses heating and refrigeration equipment and control elements. The support member supports a center body or table which includes compartments which may be heated or cooled, as well as a slab which may be cooled and a plate which may be heated. At least one column is disposed on the center body or table and supports a shield screen and light. The case may be used for self-service or buffet-style presentation.

9 Claims, 4 Drawing Sheets

FOOD DISPLAY AND PRESERVATION CASE

OBJECT OF THE INVENTION

Just as is expressed in the title of this specification, the present invention refers to a food display and preservation case, whose purpose consists of providing an element with excellent aesthetic and funcional features, that can be housed anywhere where one wishes to serve breakfasts, lunches or dinners to the public in general, in dining rooms, convention halls, gardens or other areas.

Other aims of the invention consist of the cited case keeping the cold or hot food at the desired temperatures, with some optimal conditions of hygiene and lighting with regard to the food and of hygiene and soundproofing with regard to the refrigeration and heating equipment that the case includes.

DESCRIPTION OF THE INVENTION

In order to achieve the aims indicated in the above section, the invention consists of a food display and preservation case that includes a central body or table preferably rectangular or hexagonal and with variable dimensions depending on the needs. This table has on its top surface different groups of trays, compartments, plates or the like, where the foods at the desired temperatures are displayed since said groups are connected to electrical resistors or refrigeration systems, depending on whether the foods are to be heated or kept cold.

This table or center body is on some preferably cylindrical supports in which the refrigeration units, resistor control panels, light switches and other control elements are housed, therefore the operation of the case is very silent. Besides, said supports include some rotatable wheels with brakes that make it easy to move and secure the display case.

Over the table or center body there are some columns that support some shelves and lighting elements. Said shelves are preferably made out of glass or methacrylate with the side edges curved downwards.

Under the shelves are some lighting elements of the halogen variety when additional heat is to be given to the food and of the flourescent variety when the food is only to be lighted.

Decorations, plants and other ornamental elements may be placed on the shelves.

With this constitution the food display and preservation case serves to serve food to the public rapidly and with a minimum number of employees, since the customers may serve themselves and form two lines around the case.

The conditions of hygiene that are achieved with this display case are excellent mainly due to three factors: the first one refers to the support wheels of the case, that define some small feet, whereby the support surface of the case on the floor is very small. The second one refers to the compartments and trays where the food is located. They are manufactured with rounded edges that prevent corners where dirt can accumulate and thus they are easy to clean. The third one refers to the top trays, since the edges thereof curved downward prevent people who approach the case from breathing on the food.

Hereinafter to provide a better understanding of this specification and forming an integrated part of the same, some figures in which the object of the invention has been represented in an illustrative and non-restrictive manner, are attached hereto.

DESCRIPTION OF A PREFERRED EMBODIMENT OF THE INVENTION

Hereinafter a description of an embodiment of the invention making reference to the numbering used in the figures is made.

Hence, the food display and preservation case of this embodiment has some cylindrical supports (1) that have middle bases (2) under which four rotatable wheels (3) are welded.

Figure 1:
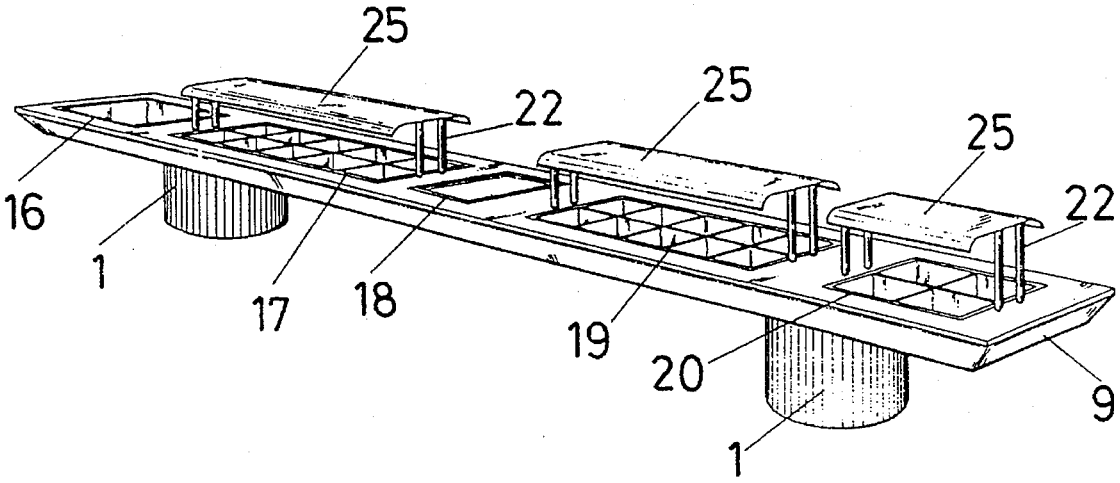
FIG. 1 represents a perspective view of a food display and preservation case, according to the present invention.
Figure 2:
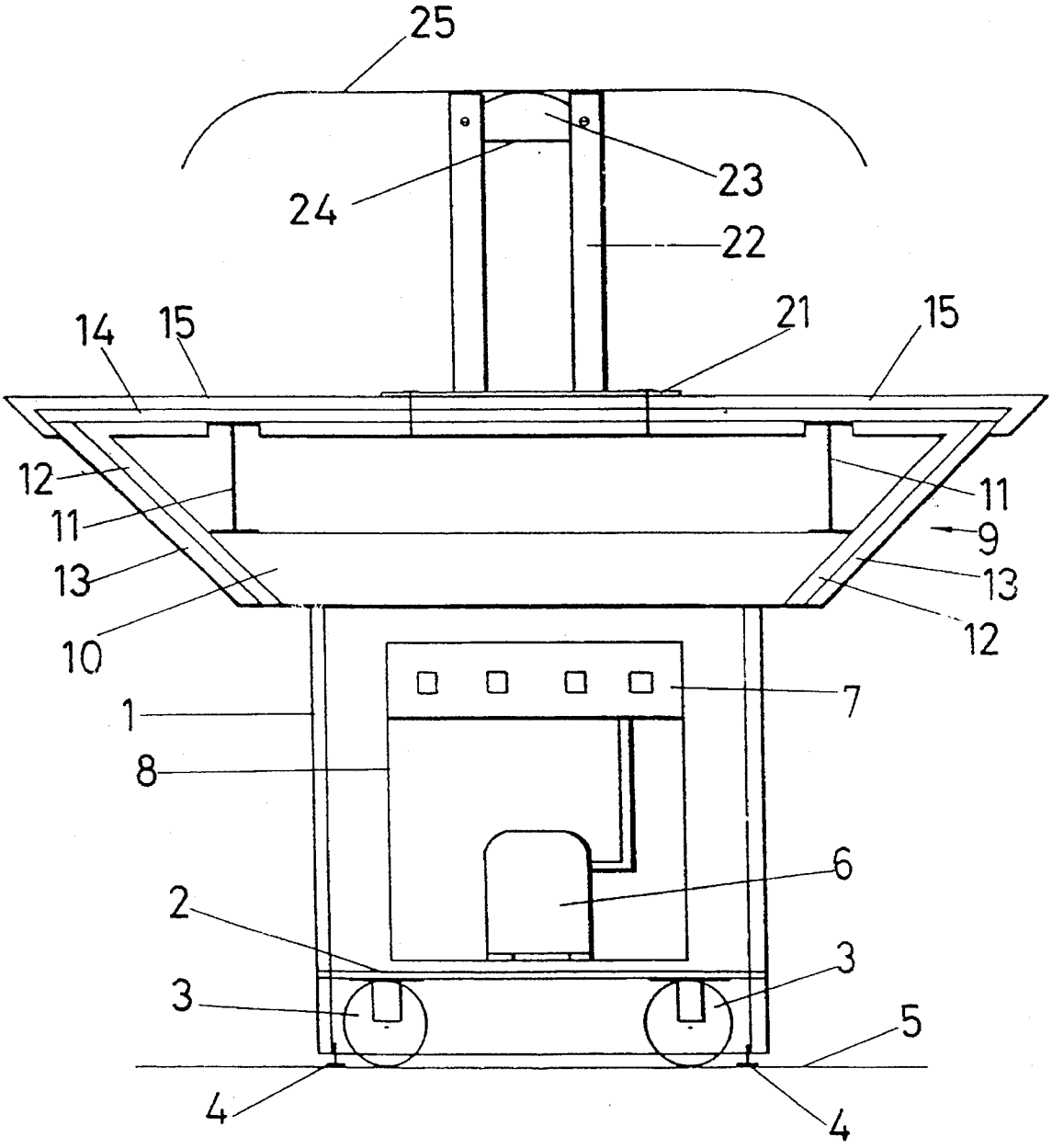
FIG. 2 represents a side schematic view of the food display and preservation case of the present invention.

The number of supports (1) will depend on the total length of the display case, there being two in the example of FIG. 1.

The bottom end of the supports (1) has four braking screws (4) corresponding with the wheels (3), so that the lowering or raising of these screws (4) determines a greater or lesser securing of the supports (1) in the corresponding floor (5.)

The middle base (2) supports the refrigeration equipment (6) and the control panels (7) of the thermostats, resistors, switches and other control elements that the case has.

These control panels (7) and refrigeration equipment are accessible by means of a door (8) existing in each support (1.)

Welded on the supports (1) there is a center body or table (9) whose top surface includes a series of food display and preservation trays, plates and compartments.

This table (9) is comprised of some cross I-beams (10) camfered at 45° on the ends thereof. Two longitudinal beams (11) also with an I-section are welded on these cross beams.

From said beams (10) and (11) a reversed pyramidic-truncated structure is formed by means of a laminated tube (12) that serves as a support of the front decoration (13) and of the top board (14.) Over this board (14) and glued with silicone a counter top (15) that is normally made of granite is placed.

Over the counter top (15) and glued with silicone the above mentioned plates and compartments are housed. In the present embodiment said plates and compartments are grouped in five types which are: hot compartment for plates (16), cold compartment for salads and appetizers (17), paella cooker or hot granite plate (18), hot compartment (19) and a cold dessert plate (20.)

Besides, over the counter top and partially covering said compartments and plates, there are some shelves-screen that are comprised of:

a stainless steel support or strip (21) that will be screwed to the counter top (15.)

some vertical stainless steel columns (22) screwed to the strips (21) and inside of which the feed cables of some lighting elements pass.

a semi-circular stainless steel screen support (23), whose length is variable depending on the area that is to be lighted.

a lighting screen (24) which depending on whether or not heat is to be transmitted, will include halogen or flourescent lights respectively.

and a top 6 mm glass or methacrylate shelf with its side edges curved downwards, supported by the columns (22) and fastened by stainless steel clips.

Figure 3:
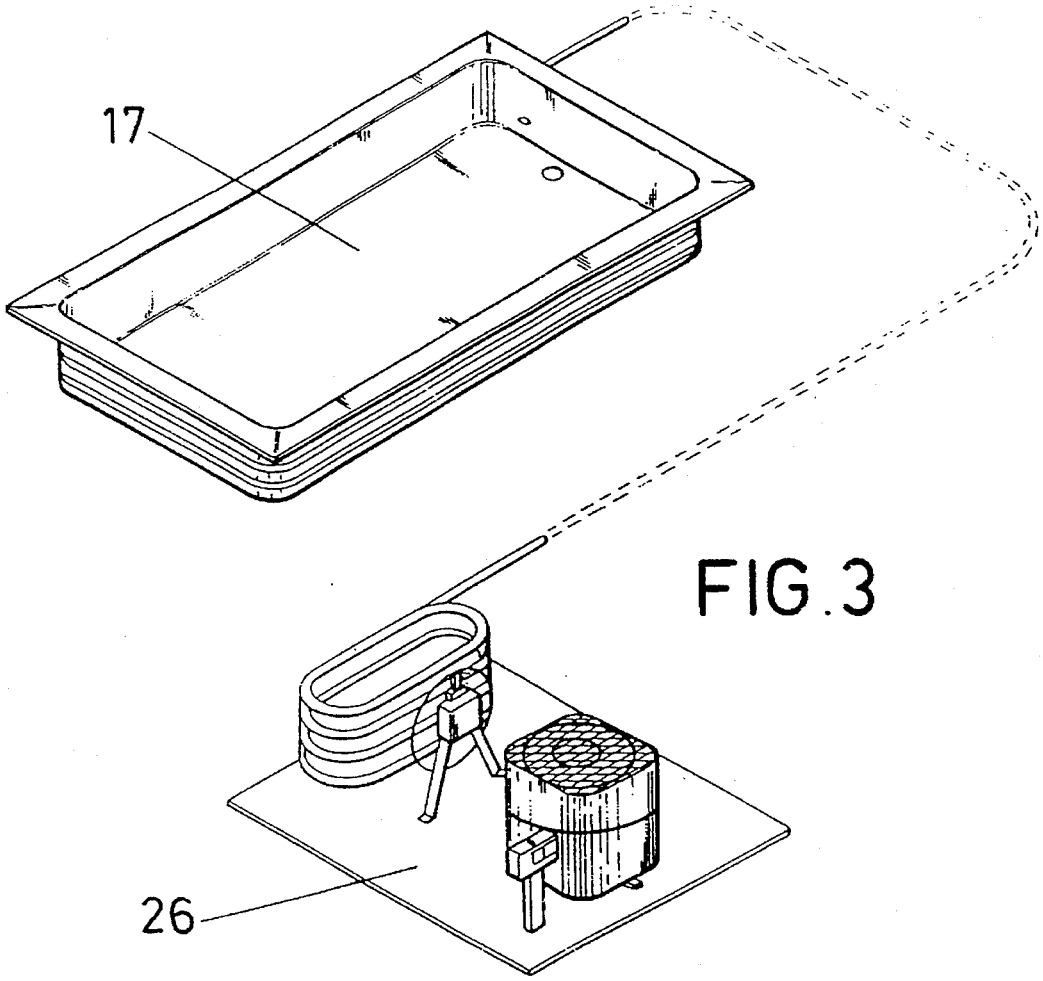
FIG. 3 represents a perspective view of a cold compartment and its connection to a refrigeration unit, of those that the food display and preservation case of the invention uses.
Figure 4:
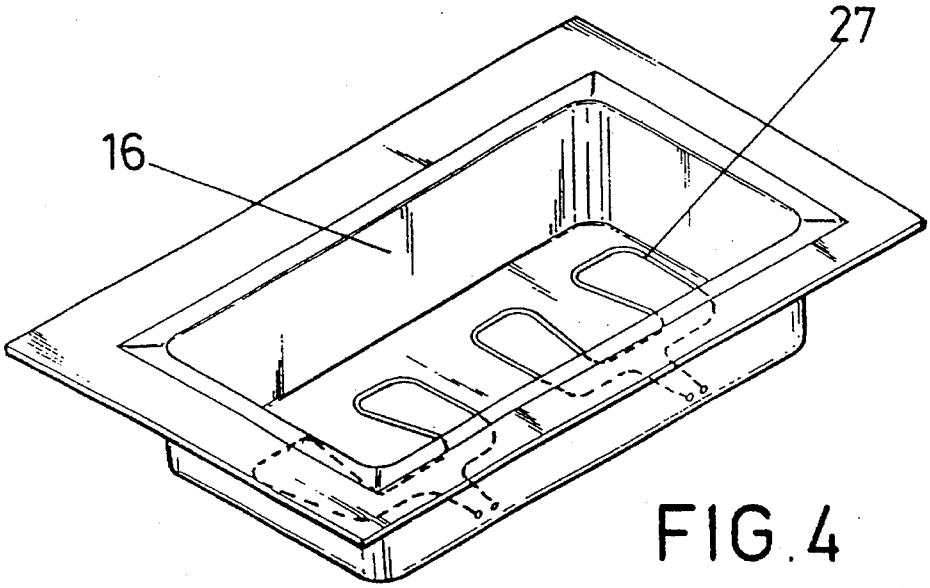
FIG. 4 represents a perspective view of a hot compartments with its resistors, of those that the food display and preservation case of the invention uses.

FIG. 3 of this example shows us the configuration of a cold compartment (17) through which the coil of a refrigeration unit (26) that will be housed in one of the cylindrical supports (1), passes. On the other hand, FIG. 4 shows a hot compartment (16) with the electric resistors (27) in the bottom thereof.

The cold compartment (17) as well as the hot compartment (16) include thermostats to adjust the temperature, all of the controls being accessible from the door (8) of the cylindrical support (1.)

Figure 5:
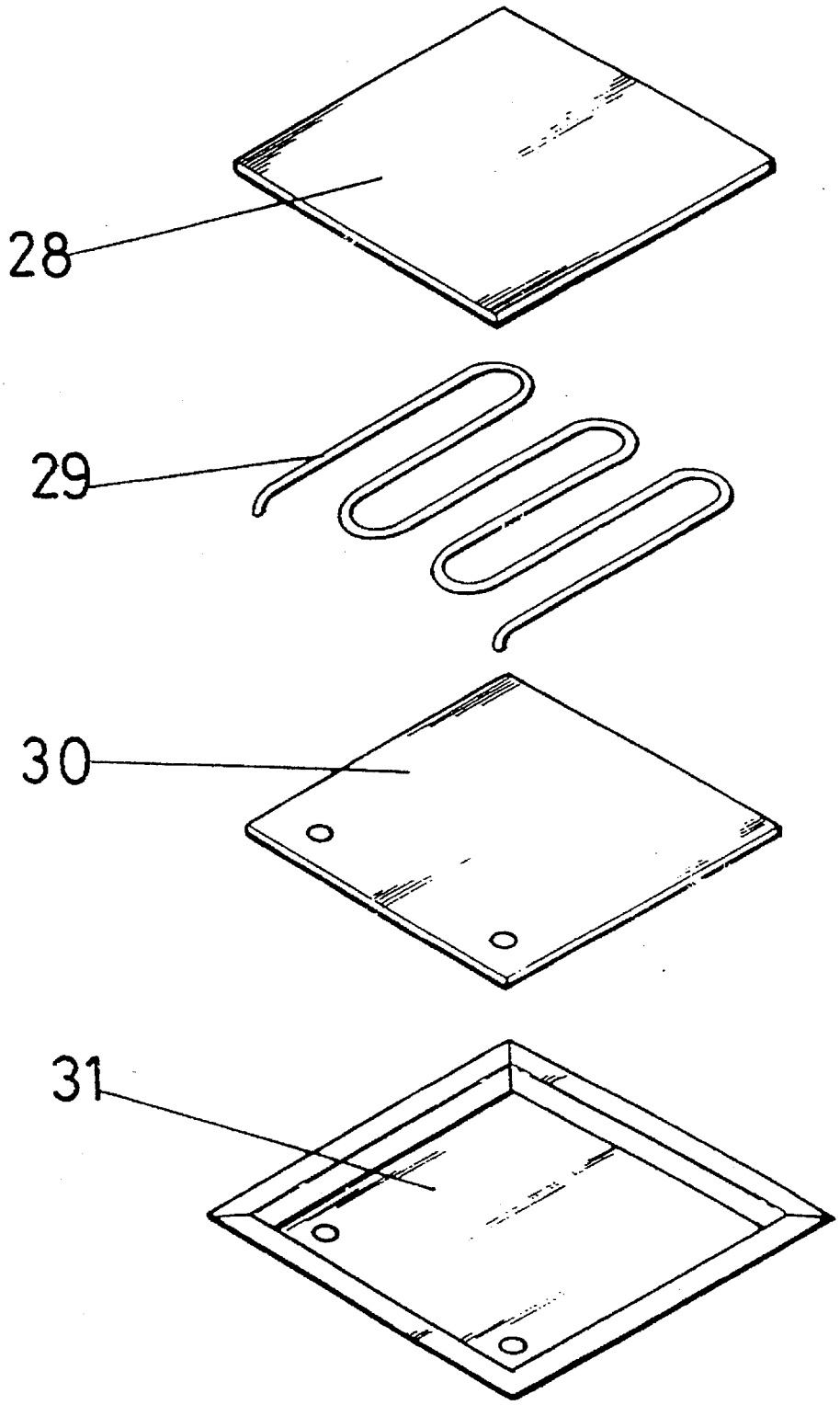
FIG. 5 represents a perspective exploded view of a granite plate of those used in the food display and preservation case of the present invention. This configuration is valid for cold as well as hot plates, depending on the tube-shaped element and the insulation used.

In FIG. 5 one can see the arrangement of the elements of a granite plate (28.) The layout can correspond to a hot plate (18) or a cold plate (20) in function of the represented elements. Hence, it corresponds to a hot plate (18) when the tube-shaped element (29) is asbestos. However, when it corresponds to a cold plate (20), the tube-shaped element (29) is copper tubing connected to the compressor of the refrigeration equipment and the insulation (30) is expanded polystyrene. In both cases, the plate (31) is a stainless steel plate in which the system is housed.

We claim:

1. Food display and preservation case, of the type that allow the people who are going to eat to serve themselves, characterized in that it has one or more preferably cylindrical supports (1) provided with wheels (3) and brakes (4) and that house and conceal different refrigeration equipment (6), resistor and lighting control panels and other control elements (7); said elements being accessible through some semi-circular doors (8); and a center body or table (9) whose surface includes different groups of compartments, trays, plates and the like connected to electric resistors or to refrigeration equipment inside the supports (1);

wherein the center body or table (9) preferably includes:

a stainless steel hot compartment (16) connected to a shielded resistor controlled by a thermostat and concealed by a stainless steel grating;

a stainless steel cold compartment connected to copper tubing connected to a compressor with a thermostat that is housed in one of the supports (1) and that compresses a refrigerant gas, transmitting cold;

a slab or cold granite table (20) that has a refrigeration system similar to that of the previous cold compartment (17);

a paella cooker or hot granite plate (18) with a system for heating the granite by means of a shielded resistor controlled by a thermostat; and another stainless steel hot compartment (19) connected to a shielded resistor controlled by a thermostat.

2. Food display and preservation case, according to claim 1, characterized in that over the table or center body (9) there are some columns (22) that support a shelf having elements to light the center body or table, and wherein at least a portion of said shelf is preferably comprised of steamproof glass or methacrylate with rounded edges.

3. A food display and preservation case comprising:

at least one heating means;

at least one refrigeration means;

a refrigeration control panel;

a heating control panel;

a lighting control panel;

at least one support provided with at least one wheel, at least one brake means, and at least one access door, wherein said support houses said refrigeration, heating, and lighting control panels and said refrigeration and heating means; and a center body or table disposed on top of said support, wherein an upper surface of said table is capable of supporting compartments, trays, plates and the like which may be connected to said heating means or said refrigeration means which is disposed inside of said support;

wherein said heating means further comprises a shielded resistor and a heating thermostat;

wherein said refrigeration means further comprises a compressor, a refrigeration thermostat, and a copper tubing connected to said compressor;

wherein said center body or table further comprises:

a first hot compartment connected to said shielded resistor and said thermostat of a first of said heating means, said hot compartment further comprising a grating which conceals said resistor and said heating thermostat;

a cold compartment connected to said copper tubing and said thermostat of a first of said refrigeration means, said cold compartment further comprising a grating which conceals said copper tubing and said refrigeration thermostat;

a slab or cold granite table connected to a second of said refrigeration means;

a paella cooker or hot granite plate connected to a second of said heating means; and a second hot compartment connected to a third of said heating means.

4. The food display and preservation case, according to claim 3 wherein said first and second hot compartments are fabricated from stainless steel.

5. The food display and preservation case, according to claim 3 wherein the gratings of said hot and cold compartments are fabricated from stainless steel.

6. The food display and preservation case, according to claim 3 wherein said cold compartment is fabricated from stainless steel.

7. The food display and preservation case according to claim 3, further comprising:

at least one support column disposed on the top surface of said table or center body;

a lighting screen having a screen support mounted to said support column;

at least one lighting element disposed above said lighting screen; and a top shelf mounted to said support column.

8. The food display and preservation case according to claim 7 wherein said top shelf further comprises rounded edges.

9. The food display and preservation case according to claim 7 wherein said top shelf is fabricated from steamproof glass or methacrylate.

* * * * *